US005908125A

United States Patent [19]

Opresco

[11] Patent Number: 5,908,125

[45] **Date of Patent: *Jun. 1, 1999**

[54] CHILD-RESISTANT SCREW-ON CAP AND BOTTLE

[75] Inventor: Ovidiu Opresco, Lic, N.Y.

[73] Assignee: Weatherchem Corporation, Twinsburg, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/835,826

[22] Filed: Apr. 16, 1997

[51] Int. Cl.[6] ..... B65D 41/04; B65D 55/02

[52] U.S. Cl. ..... 215/216; 215/217; 215/221; 215/330; 215/334

[58] Field of Search ..... 215/201, 216, 215/217, 295, 330, 329, 208, 218, 219, 221, 223, 293, 331, 334; 220/260, 281, 288, 315, 323, 324, 326, 327, 328, 345.2, 345.3

[56] References Cited

U.S. PATENT DOCUMENTS 3,399,796 9/1968 Steiner .
3,612,323 10/1971 Malick .
3,698,584 10/1972 Miller .
3,826,395 7/1974 Montgomery .
3,831,797 8/1974 Stevens, Jr. .
3,841,514 10/1974 Montgomery et al. .
3,895,730 7/1975 Koehne et al. .
4,172,533 10/1979 Montgomery .
4,326,649 4/1982 Marino et al. .
4,401,225 8/1983 Scwaikert .
4,413,742 11/1983 Sandhaus .
5,213,223 5/1993 Minnette ..... 215/216
5,671,853 9/1997 Herr ..... 215/216

*Primary Examiner*—Stephen Castellano
*Assistant Examiner*—Niki M. Eloshway
*Attorney, Agent, or Firm*—Pearne, Gordon, McCoy & Granger LLP

[57] ABSTRACT

A child-resistant bottle and screw-on cap combination that is relatively easy to open for elderly persons with limited dexterity. The cap has a construction that is particularly suited for use with extrusion blow-molded bottles. The cap and bottle locking structures afford reliable performance even when the bottle is formed of relatively soft, inexpensive thermoplastic material.

8 Claims, 2 Drawing Sheets

Fig.5
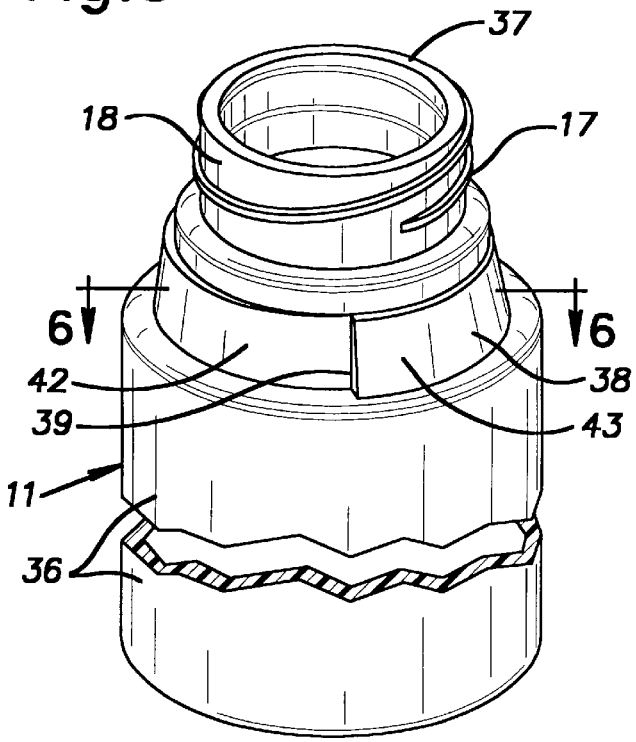
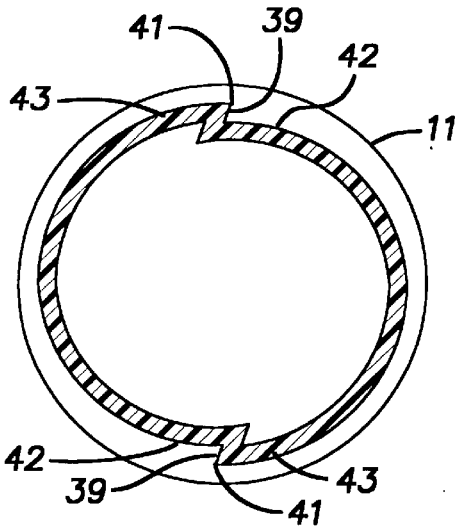
Fig.6
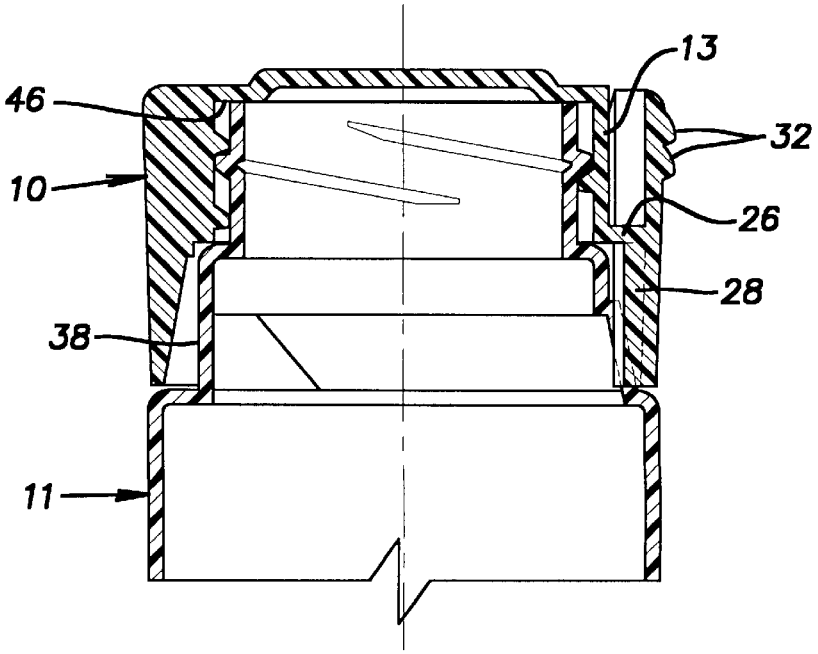
Fig.7

CHILD-RESISTANT SCREW-ON CAP AND BOTTLE

BACKGROUND OF THE INVENTION

The invention relates to child-resistant packaging and, more particularly, to a screw-on cap used with a threaded bottle.

PRIOR ART

Screw-on caps and bottle packages, when used for medicines or other potentially harmful materials, are often designed with child-resistant features to reduce the risk that a package will be opened by a child. A problem frequently encountered with such packages is that the child-resistant feature may render the package difficult to open for an adult. This problem is exacerbated when an adult user of the package is elderly, sick, arthritic or otherwise physically impaired. There continues to exist a need for a child-resistant screw-on cap that is relatively easy for an adult with limited finger and hand dexterity to open and close.

Cost is a major factor in disposable packaging and it is, therefore, desirable to utilize materials and processes that are economical in the production of the package components. For example, it is desirable to produce a bottle by extrusion blow-molding processes and it is desirable to form the bottle out of a relatively inexpensive material such as high density polyethylene.

SUMMARY OF THE INVENTION

The invention provides a child-resistant screw-on cap and bottle combination that is relatively easy to operate even for physically impaired elderly users and which can be economically mass produced. The disclosed cap includes a pair of release levers that are disposed on opposite sides of the cap. The levers and bottle include mutually inter-engageable locking surfaces. The levers must each be simultaneously squeezed towards one another to release the cap from a locking position on the bottle and enable it to be unscrewed.

In the preferred embodiment, the releasable locking levers have a readily molded simple, but highly rigid structure. The bottle locking surfaces are also simple and readily molded even in an extrusion blow-molded process. The disclosed locking surfaces on both the cap and bottle extend primarily in the axial direction as compared to their extension in the radial direction. This geometry allows the locking surface to be disengaged with relatively small release motion while still affording relatively large locking surface areas. The large surface areas of the locking elements assures that they will not be damaged when subject to abnormal forces such as when manual high unscrewing torque is applied in an attempt to force the cap open without releasing the lock levers or when the lock levers are otherwise stressed in an abnormal manner.

Where, as in the disclosed embodiment, the release levers are relatively stiff owing to their geometry and material selection, they resist distortion from their ideal configurations when unusual forces are applied to them. This rigidity and reduced distortion helps prevent damage to the bottle locking surfaces. These performance characteristics assure that when irregular and unusual forces are applied, such forces can be resisted by the full area of the bottle locking surfaces.

BRIEF DESCRIPTION OF THE DRAWINGS

FIG. 5 is a perspective view of a bottle constructed in accordance with the invention and adapted for use with the cap of FIG. 1;

FIG. 6 is a sectional view of the bottle taken in the plane 6—6 indicated in FIG. 5; and FIG. 7 is a cross-sectional elevational view of the cap and bottle, in assembled condition, taken through the plane 7—7 indicated in FIG. 4 relative to the cap.

DESCRIPTION OF THE PREFERRED EMBODIMENT

Figure 1:
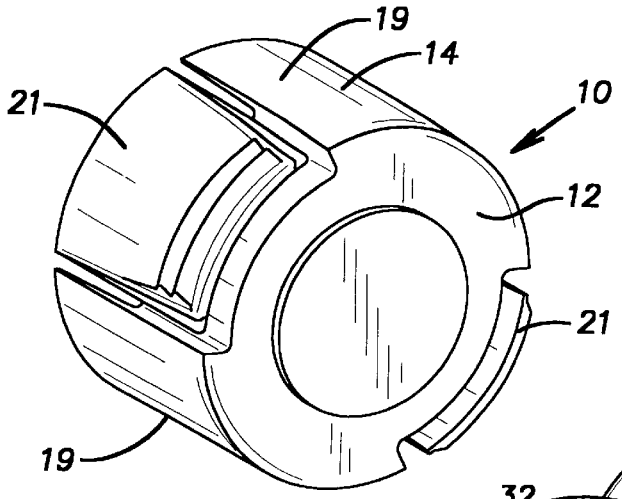
FIG. 1 is a top perspective view of a cap constructed in accordance with the invention.
Figure 2:
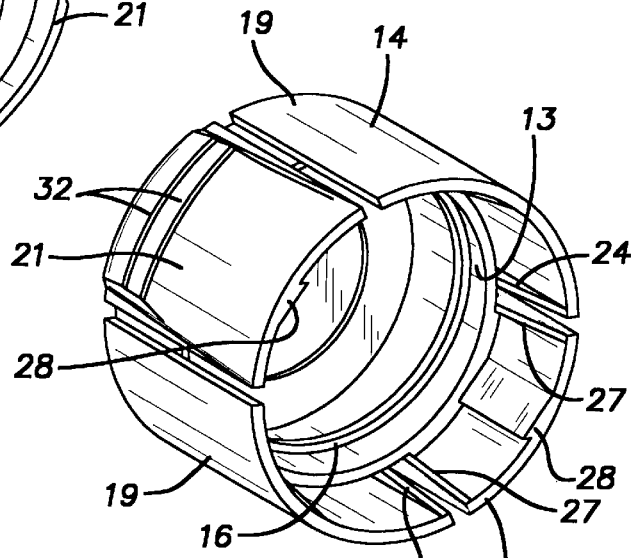
FIG. 2 is a bottom perspective view of the cap of FIG. 1.
Figure 3:
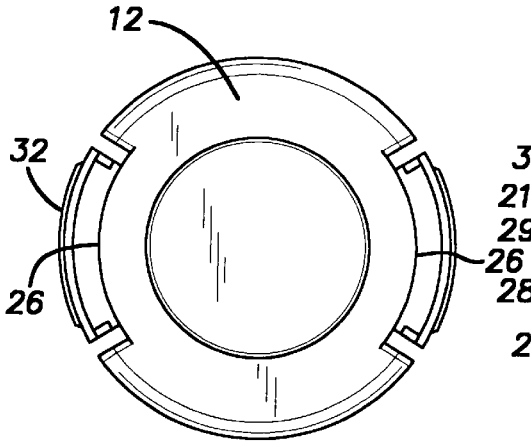
FIG. 3 is a top view of the cap of FIG. 1.
Figure 4:
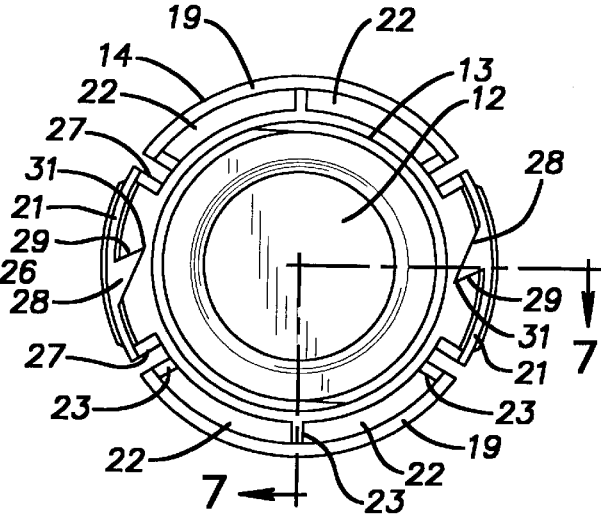
FIG. 4 is a bottom view of the cap.

FIG. 7 illustrates a cap 10 screwed on a bottle or container 11. The cap or closure 10 is a unitary injection-molded part formed of a suitable thermoplastic material such as polypropylene. In the illustrated case, the cap 10 is sized to close a bottle neck finish having a nominal 33 mm size. The cap 10 has a generally circular end wall 12 and generally cylindrical concentric skirts 13 and 14. The end wall 12 and skirts 13, 14 have a generally uniform wall thickness of about, for example, 0.045 in. The inner skirt 13 is circumferentially continuous and has internal helical threads 16 that are complimentary to external threads 17 on a neck 18 of the bottle 11. At its upper end, the skirt 13 is joined along its full circumference to the end wall 12. The outer skirt 14 is circumferentially segmented such that it includes a pair of diametrically opposed rigid sections 19 and a pair of diametrically opposed identical levers 21 intervening the rigid sections 19. As shown particularly in FIG. 4, the cap 10 is cored-out so that axially extending arcuate spaces 22 exist between the rigid sections 19 and the adjacent areas of the inner skirt 13. The levers 21, in the illustrated case, each subtend an angle of about 65° of the circumference of the cap.

Radially oriented reinforcing ribs 23 join the arcuate ends and the mid-zone of the sections 19 to the inner skirt 13 and include tapered portions 24 depending below the inner skirt.

The levers or skirt sections 21 intervening the rigid skirt sections 19 have a cylindrical or arched cross-section when viewed in an axial direction. These lever sections 21 are each joined to the inner skirt 13 by an associated web 26 that is sufficiently flexible to form a living hinge, and that has a circumferential extent generally coextensive with the associated lever. An axially extending reinforcing rib 27 is disposed in a respective radial plane along both of the axially oriented edges of each of the levers 21. Each rib 27 is generally triangular in profile in its respective plane having an apex or major width adjacent the hinge web 26 and tapering to minimum width at the top and bottom of the respective lever. A locking member 28 is formed on the radially inner surface of each lever 21 and extends from the hinge web 26 downwardly or axially to a lower edge of the lever. The locking member 28 includes a locking surface 29 that extends along its full axial length.

For purposes explained hereinbelow, the locking surface 29 is undercut, in a radial sense, on the locking member 28. The undercut character of the locking surface 29 results from lying in a plane that is oblique to an imaginary radial plane passing through the central axis of the cap 10 and a lead edge 31 of the surface 29. For example, the plane of the illustrated locking surface is at about 25–30° from the described radial plane. A pair of small circumferentially extending projections 32 on the exterior of each lever 21 provide a finger catch to facilitate manual manipulation of the lever 21 as discussed below. The projections 32 provide a tactile indication for the visually impaired or in low light environments.

The bottle 11 embodies features of the invention useful with the general type of cap described above. Ideally, the bottle 11 is made as an extrusion blow-molded product with molding processes well known in the art. The bottle 11 includes a hollow main body 36 underlying the circular neck 18. The neck 18 at its upper edge 37 forms an opening providing access to the interior of the main body 36. In the illustrated case, the body 36 has an elongated cylindrical configuration coaxial with the neck 18 but, it can have other shapes. The upper edge 37 lies in a flat plane transverse to the central axis of the circular neck 18. Below the neck 18, the bottle 11 includes a shoulder 38 on which are located two diametrically opposite identical locking surfaces 39. The locking surfaces 39 each lie in planes parallel to the axis of the neck 18. Ideally, similarly to the locking surfaces 29 on the cap 10, the bottle locking surfaces 39 are undercut in the sense that the planes of the surfaces are oblique by an angle of, for example, about 20° to an imaginary plane extending from the central axis of the neck to their respective salient edges 41. Preferably, this angle is somewhat less than the corresponding angle on the cap locking surface 29. Areas 42 of the shoulder 38 immediately in front of the locking surfaces 39, in a clockwise sense looking downwardly from the top of the bottle, is smaller in diameter than areas 43 immediately behind the locking surfaces. The leading area can be cylindrical for a limited circumferential distance. In contrast, the trailing area can be conical for a circumferential distance tapering radially outwardly with reference to a downward direction away from the neck 18.

Ideally, for purposes of economy, the bottle 11 is made in an extrusion blow-molded process. The material forming the bottle 11 can be any suitable thermoplastic material and can preferably be high density polyethylene. The illustrated bottle 11 has a wall thickness of about 0.050 in. in the area of the neck 18 and the main body 36 has a proportionately thinner wall, in the illustrated case being about 0.035 in. depending generally on the local diameter of the bottle. The bottle wall thickness in the area of the locking surfaces 39 is between the neck thickness and body thickness. The wall thickness of the bottle 11 remains relatively constant at a given diameter and local projections on the wall such as represented by the threads 17 (FIG. 7) and the locking projections (FIG. 6) are reflected as indentations or concave zones at their respective internal areas of the bottle.

The major length of each locking surface 39 measured along a line generally parallel to the plane of the adjacent principal shoulder wall area represented by the conical area 43 and directed away from the neck and in a plane generally parallel to the neck axis is substantially greater than the bottle wall thickness being, in the illustrated case, for example, about 5 times that thickness. Additionally, this major length of the locking surfaces 39 is substantially greater than the transverse width of the surfaces, that is, the width of the surfaces in the direction that is generally perpendicular to the plane of the adjacent principal shoulder wall area.

The geometry of the locking surfaces 29 on the cap 10 is similar to that of the bottle. More specifically, the axial and radial lengths of these locking surfaces 29 are similar to that of the bottle. The axial working length of the surfaces 29 where they can contact the bottle surfaces 39 is substantially greater than the wall thickness of the cap being, for example, about 6½ times the wall thickness in the illustrated example. Additionally, for example, the axial working length of the locking surfaces 29 is at least about 3 times the average radial width of the locking surface.

As is conventional, the threads 16, 17 on the cap and bottle correspond to a right hand helix. In use, the cap 10 is screwed onto the bottle neck 18. Initially, this is typically done in an automatic capping machine where the bottle 11 is first filled with product. A liner can be fitted in the cap, if desired. The cap 10 and bottle 11 are proportioned so that a sealing surface 46 of the cap 10 seats against the top edge 37 of the neck 18, with any specified liner therebetween, at the same relative angular position that the locking surfaces 29 of the cap 10 snap past the bottle locking surfaces 39. Prior to this action, the lower ends of the locking levers 21 are cammed radially outwardly by the conical surfaces 43. The cap 10 is then releasably rotationally locked onto the bottle 11. To remove or unlock the cap 10, both of the locking levers 21 must be squeezed simultaneously towards one another near their upper ends above the web hinge 26 and, while the levers are squeezed, the cap must be unscrewed in the counter-clockwise direction. Squeezing the tops of the levers 21 causes the levers to pivot on the hinge web areas 26 and the lower ends of the levers to move radially outwardly so that the locking surfaces 39 of the bottle 11 do not obstruct movement of the locking surfaces 29 of the cap 10 angularly about the axis of the neck 18. The pitch of the threads 16, 17 is preferably arranged so that with a half turn of unscrewing, the locking surfaces 39, 29 do not interfere even when the levers 21 are not squeezed. The cap is thus convenient to use since the levers need only be squeezed once for opening of the cap.

The relatively large levers and their simple release movement make the cap user-friendly, particularly in the case of a person who is somewhat physically impaired by advanced age or arthritis. A child typically does not have sufficient coordination, dexterity and understanding to open the cap 10.

Efforts to unscrew the cap 10 where the tops of the locking levers are not appropriately simultaneously squeezed is prevented by interference between the bottle and cap locking surfaces 29, 39. The configuration of the lock levers 21, having a cylindrical arch, reinforced by the ribs 23 and the locking member 28 is exceptionally stiff so as to resist distortion despite the cantilever nature of the levers. As shown, the depending free length of a lever 21 below its web hinge 26 is somewhat shorter than the chordal length of the lever at the web hinge thereby ensuring the stiffness of the lever. When an effort is made to forcibly overcome the locking action of the locking surfaces, this rigidity helps maintain the locking surfaces in alignment so that forces are distributed evenly over the surfaces and the tendency to plasticly deform them is minimized. This feature is especially important where the bottle is made of relatively soft material. Another feature that improves locking performance are the undercut orientations of both the cap and bottle locking surfaces 29, 39 which develops a self-energizing effect to increase their tendency to stay engaged when an attempt to unscrew the cap is made without squeezing the levers 21.

It should be evident that this disclosure is by way of example and that various changes may be made by adding, modifying or eliminating details without departing from the fair scope of the teaching contained in this disclosure. For example, the exterior of the cap can be formed with a non-circular shape and, similarly, the main body of the bottle can be non-circular in shape. The invention is therefore not limited to particular details of this disclosure except to the extent that the following claims are necessarily so limited.

What is claimed is:

1. A child-resistant cap for a unitary thermoplastic molded bottle with a main body and a circular neck above the main body providing an opening at the top of the bottle, the neck defining a central axis and having an external thread, a pair of external locking surfaces on the bottle below the threads of the neck on diametrally opposite locations relative to the axis, the locking surfaces having a length measured along the surface of the bottle in a direction away from the threads on the neck that is several times the adjacent wall thickness of the bottle, the cap comprising a unitary thermoplastic molded body, the cap having an end wall and a pair of concentric skirts depending from the end wall, an inner one of said skirts having an internal thread compatible with the external thread on the bottle neck, the outer skirt being circumferentially segmented and providing a pair of diametrally opposed lock levers, each of the lock levers being supported on the inner skirt by a living hinge, each lock lever having a finger engageable portion above the hinge and a bottle contacting portion below the hinge, the bottle contacting portion including a locking surface directly engageable with a bottle locking surface when the cap is threaded into a closed position on the bottle, each cap lever locking surface having an operative length, along a zone adjacent the bottle in a direction generally parallel to an associated one of said bottle locking surface length directions, that is several times the nominal wall thickness of the cap and is equal to a substantial portion of the length of the lock lever, each cap lever locking surface being circumferentially directly supported along substantially its full length by contiguous, continuous portions of the body of the lock lever that extend along such locking surface and along the respective hinge a distance substantially at least as long as the length of the cap lever locking surface whereby it resists distortion when an effort is made to unscrew the cap with the lock lever in a locked position.

2. A child-resistant bottle and cap package comprising a unitary thermoplastic molded bottle with a main body and a circular neck above the main body providing an opening at the top of the bottle, the neck defining a central axis and having an external thread, a pair of external locking surfaces on the bottle below the threads of the neck on diametrally opposite locations relative to the axis, the locking surfaces having a length measured along the surface of the bottle in a direction away from the threads on the neck that is several times the adjacent wall thickness of the bottle, and a unitary thermoplastic molded cap, the cap having an end wall and a pair of concentric skirts depending from the end wall, an inner one of said skirts having an internal thread compatible with the external thread on the bottle neck, the outer skirt being circumferentially segmented and providing a pair of diametrally opposed lock levers, each of the lock levers being supported on the inner skirt by a living hinge, each lock lever having a finger engageable upper lever portion above the hinge and a bottle contacting lower lever portion below the hinge, the lower lever contacting portion including a locking surface directly engageable with a bottle locking surface when the cap is threaded into a closed position on the bottle, each cap lever locking surface having an operative length, along a zone adjacent the bottle in a direction generally parallel to an associated one of said bottle locking surface length directions, that is several times the nominal wall thickness of the cap and is equal to a substantial portion of the length of the lock lever, each cap lever locking surface being circumferentially directly supported along substantially its full length by contiguous, continuous portions of the lock lever that extend along such locking surface and along the respective hinge a distance substantially at least as long as the length of the cap lever locking surface whereby it resists distortion when an effort is made to unscrew the cap with the lock lever in a locked position.

3. A child-resistant package as set forth in claim 2, wherein both said upper and lower lever portions extend in a circumferential direction through a relatively large arcuate distance.

4. A child-resistant package as set forth in claim 2, wherein said lower lever portions have arcuate cross-sections in a plane perpendicular to the axis of the cap.

5. A child-resistant package as set forth in claim 2, wherein said length directions of said bottle locking surfaces and said cap locking surfaces extend primarily along an axial direction.

6. A child-resistant package as set forth in claim 2, wherein said bottle and cap locking surfaces are narrow compared to their length dimensions.

7. A child-resistant package as set forth in claim 2, wherein said bottle is an extrusion blow-molded product.

8. A child-resistant package as set forth in claim 2, wherein said locking surfaces are undercut in a manner that decreases a tendency to slip out of locking engagement when an unscrewing force is applied without squeezing the levers.

* * * * *

UNITED STATES PATENT AND TRADEMARK OFFICE

CERTIFICATE OF CORRECTION

PATENT NO. : 5,908,125
DATED : June 1, 1999
INVENTOR(S) : Ovidiu Opresco

It is certified that error appears in the above-indentified patent and that said Letters Patent is hereby corrected as shown below:

On the title page of the patent, Section [56] the inventor of U.S. Patent 4,401,225 should read "Schwaikert".

On the title page of the patent, Section [56], insert the following:

| | | |
|---|---|---|
| --4,479,585 | 10/1984 | Sandhaus |
| 4,500,006 | 2/1985 | Lafortune et al. |
| 4,687,112 | 8/1987 | Swartzbaugh |
| 4,752,013 | 6/1988 | Miller et al. |
| 4,752,014 | 6/1988 | House et al. |
| 5,449,077 | 9/1995 | Seidler |
| 5,603,421 | 2/1997 | Opresco-- |

Claim 2, line 20 (column 6, line 8), delete "contacting".

Signed and Sealed this

Twenty-third Day of November, 1999

*Attest:*

Q. TODD DICKINSON

*Attesting Officer*

*Acting Commissioner of Patents and Trademarks*